US009938867B2

(12) United States Patent
Brett et al.

(10) Patent No.: US 9,938,867 B2
(45) Date of Patent: Apr. 10, 2018

(54) CARTRIDGE AND SYSTEM FOR REPLENISHING FLUID IN AN APPARATUS

(71) Applicants: CASTROL LIMITED, Swindon, Wiltshire (GB); Peter Stuart Brett, Berkshire (GB); Steven Paul Goodier, Berkshire (GB); Piers Sebastian Harding, Hertfordshire (GB); Gary Keith Jepps, Hertfordshire (GB); Thomas James McPherson, Hertfordshire (GB); Michael Paul Sheldon, Cambridgeshire (GB); Matthew Paul Wright, Cambridgeshire (GB)

(72) Inventors: Peter Stuart Brett, Berkshire (GB); Steven Paul Goodier, Berkshire (GB); Piers Sebastian Harding, Cambridgeshire (GB); Gary Keith Jepps, Cambridgeshire (GB); Thomas James McPherson, Cambridge (GB); Michael Paul Sheldon, Cambridge (GB); Matthew Paul Wright, Newmarket (GB)

(73) Assignee: Castrol Limited, Pangbourne Reading (GB)

( * ) Notice: Subject to any disclaimer, the term of this patent is extended or adjusted under 35 U.S.C. 154(b) by 270 days.

(21) Appl. No.: 14/443,615

(22) PCT Filed: Nov. 19, 2013

(86) PCT No.: PCT/EP2013/074205
§ 371 (c)(1),
(2) Date: May 18, 2015

(87) PCT Pub. No.: WO2014/076316
PCT Pub. Date: May 22, 2014

(65) Prior Publication Data

US 2015/0291317 A1 Oct. 15, 2015

(30) Foreign Application Priority Data

Nov. 19, 2012 (EP) ..... 12193246
Feb. 28, 2013 (EP) ..... 13157219
Feb. 28, 2013 (EP) ..... 13157223

(51) Int. Cl.
*F01M 11/04* (2006.01)
*B65D 25/38* (2006.01)

(52) U.S. Cl.
CPC ..... *F01M 11/04* (2013.01); *B65D 25/38* (2013.01); *F01M 2011/0483* (2013.01)

(58) Field of Classification Search
CPC ..... B65D 50/041; B65B 25/18; F01M 11/04; F01M 2011/0483
(Continued)

(56) References Cited

U.S. PATENT DOCUMENTS 2,817,373 A * 12/1957 Tapp ..... B01L 3/50 141/314
2,976,864 A 3/1961 Ford
(Continued)

FOREIGN PATENT DOCUMENTS

CN 1091177 8/1994
CN 2549181 5/2003
(Continued)

*Primary Examiner* — Timothy L Maust
*Assistant Examiner* — Timothy P Kelly
(74) *Attorney, Agent, or Firm* — McDonnell Boehnen Hulbert & Berghoff LLP

(57) ABSTRACT

A cartridge for replenishing a vehicle fluid, a fluid reservoir system comprising same and a holder, a holder, a vehicle engine comprising the fluid reservoir system and a vehicle comprising said engine in which, the cartridge comprises: a housing comprising a first part and a second part; a fluid reservoir in the housing; a port arranged on the first part of the housing to couple the reservoir in fluidic communication
(Continued)

with a fluid system of the vehicle; wherein the second part of the housing is configured to rotate with respect to the first part of the housing to secure the cartridge with respect to the fluid system to hold the reservoir in fluidic communication, via the port, with the fluid system of the vehicle, wherein the second part of the housing is configured such that rotating the second part of the housing does not rotate the port.

21 Claims, 6 Drawing Sheets

(58) Field of Classification Search
USPC ..... 141/313–317, 383–386, 363–366, 22, 141/346–347
See application file for complete search history.

(56) References Cited

U.S. PATENT DOCUMENTS

| | | | | | |
|---|---|---|---|---|---|
| 3,399,776 | A | | 9/1963 | Knuth | |
| 3,246,802 | A | | 4/1966 | Fuhrmann | |
| 4,060,105 | A | * | 11/1977 | Feldeisen | G03G 15/087 141/1 |
| 4,151,823 | A | | 5/1979 | Grosse et al. | |
| 4,676,287 | A | * | 6/1987 | Fitzwater | A47L 11/30 141/285 |
| 5,454,354 | A | | 10/1995 | Miller | |
| 5,640,936 | A | * | 6/1997 | Hudson | F01M 1/12 123/196 A |
| 6,048,454 | A | * | 4/2000 | Jenkins | B01D 36/001 210/172.1 |
| 6,348,149 | B1 | | 2/2002 | Jenkins | |
| 6,793,818 | B1 | | 9/2004 | Entringer et al. | |
| 2006/0180395 | A1 | | 8/2006 | Graf | |
| 2009/0211552 | A1 | | 8/2009 | Prior et al. | |
| 2011/0253092 | A1 | | 10/2011 | Springer et al. | |
| 2015/0291318 | A1 | | 10/2015 | Barnes et al. | |
| 2015/0292371 | A1 | | 10/2015 | Barnes et al. | |
| 2015/0292372 | A1 | | 10/2015 | Barnes et al. | |
| 2015/0292674 | A1 | | 10/2015 | Brett et al. | |

FOREIGN PATENT DOCUMENTS

| | | |
|---|---|---|
| CN | 102515070 | 6/2012 |
| DE | 10136971 | 2/2003 |
| DE | 102008040748 | 1/2010 |
| DE | 102012024365 | 6/2014 |
| EP | 1104867 | 6/2001 |
| FR | 2633976 | 1/1990 |
| FR | 2881508 | 8/2006 |
| WO | WO 01/53663 | 7/2001 |
| WO | WO 03/106598 | 12/2003 |
| WO | WO 2016/158971 | 10/2016 |

* cited by examiner

CARTRIDGE AND SYSTEM FOR REPLENISHING FLUID IN AN APPARATUS

This application is the U.S. National Phase of International Application No. PCT/EP2013/074205 filed Nov. 19, 2013 which designated the U.S. and claims priority to European Patent Application No. 12193246.1 filed Nov. 19, 2012, European Patent Application No. 13157219.0 filed Feb. 28, 2013, and European Patent Application No. 13157223.2 filed Feb. 28, 2013, each of which is hereby incorporated by reference in its entirety.

This invention relates to apparatus including a cartridge and in particular to a cartridge for replenishing a vehicle fluid, for example a vehicle engine fluid. The present invention also relates to a holder for a cartridge, a fluid reservoir system, an engine and a vehicle.

Many vehicle engines use one or more fluids for their operation. Such fluids are often liquids. For example, it is usual for an internal combustion engine to be lubricated with a liquid lubricating oil composition. Also, it is usual for an electric engine to use a heat exchange liquid for example to cool the engine, to heat the engine or to cool and heat the engine during different operating conditions. Such fluids are generally held in reservoirs associated with the engine, in particular in fluidic communication with the engine. Such fluids may require periodic replacement.

Conventional periodic replacement of engine lubricating oil composition in a vehicle engine usually involves draining the composition from the engine sump. The process may also involve removing and replacing the engine oil filter. Such a procedure usually requires access to the engine sump drain plug and oil filter from the underside of the engine, may require the use of hand tools and usually requires a suitable collection method for the drained lubricating oil composition.

U.S. Pat. No. 4,151,823 relates to a quick-change oil filter/reservoir system for an internal combustion engine having a primary oil pump and oil sump comprising a cartridge containing an oil filter element and supply of oil. In one embodiment shown in FIG. 1 of U.S. Pat. No. 4,151,823, and described at col. 3 lines 22 to 30, the cartridge is said to be retained on the mounting plate by conventional quick release mountings. The tabs and spring clips shown in the embodiment of FIG. 1 of U.S. Pat. No. 4,151,823 are on the end of the cartridge bearing the inlet and outlet ports. The breather cap in this embodiment is shown with a pipe connected to the cap.

U.S. Pat. No. 5,454,354 relates to a combined oil filter/reservoir cartridge for an internal combustion engine mounted outboard of the engine for easy access. The device includes an oil filter and has sufficient capacity to hold all of the engine oil. An auxiliary pump is included to pump fresh oil from a new device into the engine and to pump the old oil into the reservoir. The device can then be demounted and the contents and cartridge recycled. It is stated therein that the inlet and outlet ports of the cartridge connect to the oil distribution system by quick disconnect members so that the cartridge can be easily disconnected from the system.

U.S. Pat. No. 5,640,936 relates to a removable oil tank and oil filter for four cycle dry sump internal combustion engines having particular utility in marine engines.

WO 01/53663 relates to a removable and disposable oil cartridge device linked to an internal combustion engine regulating interface for manually filling or emptying and automatically regulating the engine lubricating oil, wherein the interface comprises as system of controlled valves in which the controlled valve system provides a configuration of specific circuits for each of the requirements for the proper running of the engine lack of oil, stable running conditions, oil overflow) and the proper filling or emptying when the cartridge is manually changed.

According to WO 2001/53663 by reference to FIG. 26 it is stated that a new cartridge full of oil in the expanded state is fitted by positioning the new cartridge without support on the fixing support (50a) and as soon as one then starts to press on the cartridge one engages this in guidance in the locking devices (50a) and possibly in other latching, snapping etc. systems, not represented.

U.S. Pat. No. 6,048,454 relates to an oil filter pack and assembly for lubricating a system such as an engine. In one embodiment illustrated in FIGS. 2 to 8 an oil pack is described which has self-sealing male couplings at the top of a housing for oil and self-sealing female plugs for connecting the male plugs to corresponding lines or hoses. A mechanism is provided to simultaneously disconnect the female plugs and the three lines are aligned so as to prevent mis-connection. It is stated therein (col 7 lines 8 to 18) that the oil receptacle is securely positioned within a void of the engine compartment or other suitable location by suitable bracketing means. This is illustrated with a bracket which has a clip. Another embodiment illustrated in FIGS. 10 to 14, has couplings at the top of an oil receptacle and at the base/underneath the receptacle.

Thus, in a first aspect of the present disclosure there is provided a cartridge for replenishing a vehicle fluid, the cartridge comprising: a fluid reservoir; a housing comprising a first part and a second part; a port arranged on the first part of the housing to couple the reservoir in fluidic communication with a fluid system of the vehicle; wherein the second part of the housing is configured to rotate with respect to the first part of the housing to secure the cartridge with respect to the fluid system to hold the reservoir in fluidic communication, via the port, with the fluid system of the vehicle, and wherein the second part of the housing is configured such that rotating the second part of the housing with respect to the first part of the housing does not rotate the port.

Aspects of the disclosure address the technical problems identified by providing a cartridge for replenishing a vehicle fluid, the cartridge comprising: a fluid reservoir; a housing comprising a first part and a second part; a port arranged on the first part of the housing to couple the reservoir in fluidic communication with a fluid system of the vehicle; wherein the second part of the housing is configured to rotate with respect to the first part of the housing to secure the cartridge with respect to the fluid system to hold the reservoir in fluidic communication, via the port, with the fluid system of the vehicle, and wherein the second part of the housing is configured such that rotating the second part of the housing with respect to the first part of the housing does not rotate the port.

These and other examples of the disclosure enable vehicle fluids to be conveniently replaced by a cartridge that can be secured with respect to the fluid system without the need for a user to perform any complex operation on the vehicle.

The first part of the housing and the second part of the housing may cooperate to encapsulate the reservoir. Alternatively, the reservoir may be encapsulated by either one of the first and second part, whilst the respective other part of the housing is carried by the part of the housing which encapsulates the reservoir. For example, the second part of the housing may comprise one of a turret, cuff and a cap carried by the first part of the housing.

The second part of the housing may comprise a handle, for example provided by a recess and a bar across the recess.

This and other examples of the disclosure enable the second part of the housing to be conveniently gripped and manipulated so that the cartridge can be easily decoupled and removed from the fluid system.

The first part of the housing may comprise a handle, for example provided by a recess and a bar across the recess. This and other examples of the disclosure enable the cartridge to be conveniently gripped, carried and manipulated.

The cartridge may comprise a deployable lug arranged to be deployed from the cartridge to secure the cartridge with respect to the fluid system in response to rotation of the second part of the housing with respect to the first part of the housing.

The second part of the housing may be configured to provide a bayonet fitting to secure the cartridge with respect to the fluid system, for example the second part of the housing may comprise one or more lugs, each being co-operable with a complementary recess coupled to the fluid system, by rotation of the second part of the housing with respect to the first part of the housing to engage the lugs with the recesses thereby to retain the cartridge in fluidic communication with the engine fluid system through said port. Alternatively, the second part of the housing may comprise one or more recesses, each being co-operable with a complementary lug coupled to the fluid system, by rotation of the second part of the housing with respect to the first part of the housing to engage the lugs with the recesses thereby to retain the cartridge in fluidic communication with the engine fluid system through said port. In yet another example, the second part of the housing may comprise one or more lugs and one or more recesses, each being co-operable with a complementary recess or lug respectively coupled to the fluid system, by rotation of the second part of the housing with respect to the first part of the housing to engage each lug and with its corresponding recess thereby to retain the cartridge in fluidic communication with the engine fluid system through said port.

When the second part comprises one of a turret, cuff and a cap, the turret, cuff or cap may comprise one or more lugs and/or one or more recesses each being co-operable with a complementary recess or lug respectively coupled to the fluid system, by rotation of the second part of the housing with respect to the first part of the housing to engage the lugs with the recesses thereby to retain the cartridge in fluidic communication with the engine fluid system through said port.

Thus, according to a further aspect of the disclosure there is provided a cartridge for replenishing a vehicle fluid comprising:

a housing comprising a first and second part;

a fluid reservoir in the housing;

at least one port arranged on the first part of the housing to couple the reservoir in fluidic communication with a fluid system of the vehicle;

wherein the second part of the housing is configured to rotate with respect to the first part of the housing to secure the cartridge with respect to the fluid system to hold the reservoir in fluidic communication, via the port, with the fluid system of the vehicle, wherein the second part of the housing is configured such that rotating the second part of the housing does not rotate the port, and wherein the second part comprises a turret, cap or cuff which is rotatable with respect to the first part;

and said turret, cap or cuff comprises one or more lugs, recesses or combination thereof each being co-operable with a complementary recess or lug respectively coupled to the fluid system, by rotation of the second part of the housing with respect to the first part of the housing to engage the lugs with the recesses thereby to hold the reservoir in fluidic communication with the fluid system through said port.

The cartridge may be engaged and disengaged from the engine and fluid system by rotation of the lugs and recesses relative to each other without rotating the port or ports. This facilitates fitting and removing the cartridge and replenishing the vehicle fluid.

The one or more lugs and/or one or more recesses coupled to the fluid system may be on or part of a holder, for example a sleeve, adapted to receive the housing. The holder, for example, sleeve, may comprises: one or more of said lugs, one or more of said recesses, or a combination of one or more of said lugs and one or more of said recesses.

In some embodiments the holder, for example sleeve, comprises one or more of said recesses which are slots in said holder.

In some embodiments, the holder, for example sleeve, is associated with the fluid system, for example being positioned on or part of the system, for example on or part of an engine, for example a vehicle engine. The holder, for example sleeve, may be located in a convenient space in an engine compartment of the vehicle, and suitably is readily accessible from the top of the engine compartment.

Rotation of the second part of the housing with respect to the first part of the housing may comprise rotation through an angle of less than 360° for example through an angle of between 10° and less than 360° or through an angle of between 10° and 180°, or through an angle of between 10° and 60°, or through an angle of about 25°.

Rotation of the second part of the housing with respect to the first part of the housing in a first direction secures the cartridge with respect to the fluid system and holds the reservoir in fluidic communication, via the port, with the fluid system, for example with the fluid system of the vehicle e.g. the vehicle engine. Rotation of the second part of the housing in a direction opposite to the first direction of rotation disengages the cartridge and reservoir from the fluid system.

These and other examples of the disclosure facilitate fitting and removal of the cartridge on the vehicle.

In some embodiments, the housing is elongate with a longitudinal axis and the second part is rotatable with respect to the first part about the longitudinal axis of the housing. In some embodiments the port or ports is/are located at one end of the housing.

In some embodiments the second part of the housing comprises a turret, cap or cuff, at least a portion of which is rotatable with respect to the first part of the housing for example about a common axis of the first and second parts, to engage or disengage lugs and their corresponding recesses. In some embodiments, the port or ports of the cartridge is/are located at one end of the cartridge and the turret, cap or cuff is located at the opposite end of the cartridge.

In some embodiments the turret, cap or cuff comprises one or more lugs engageable with one or more corresponding recesses, for example in a holder for the cartridge, for example a sleeve. Suitably, the turret, cap or cuff comprises one, two, three or four lugs engageable with a corresponding number of recesses, for example in a holder for the sleeve, for example a sleeve.

Suitably, the lugs extend radially from the turret, cap or cuff and the corresponding recesses are slots for example in a holder for the cartridge, for example a sleeve.

Each of the recesses may comprise a first portion which is generally parallel to the rotational axis and a second portion which is generally at right angles to said first portion whereby in use with each lug engaged with the first portion of its corresponding recess, said first portion permits axial movement of the cartridge along said rotational axis which is for example, the longitudinal axis of the housing, and with each lug engaged with the second portion of its corresponding recess, said second portion permits relative rotation of said lugs and their corresponding recesses. Thus, this permits the cartridge which, with each lug engaging the first portion of its corresponding recess, can be slid along the rotational axis until each port of the cartridge engages the corresponding port of the fluid system of the vehicle engine and then, with each lug engaging the second portion of its corresponding recess, rotation of the lugs and recesses relative to each other by rotation of the second part of the housing for example by rotation of the turret, cap or cuff, if present, with respect to the first part of the housing secures the cartridge with respect to the fluid system of the engine, wherein rotating the second part of the housing does not rotate the port or ports.

Each recess may further comprise a third portion which is located at a distal end of the second portion and provides a detent to retain the corresponding lug in a fully engaged position.

In some examples the turret, cap or cuff further comprises a handle which is adapted to permit carrying of the cartridge and rotation of the turret, cap or cuff with respect to the first part of the housing of the cartridge.

In some examples the cartridge further comprises a handle which is adapted to permit carrying of the cartridge and rotation of second part of the housing with respect to the first part of the housing.

The handle may permit rotation of the second part by rotation of a turret, cap or cuff and removal of the cartridge from the engine. Repositioning and engaging a new or replacement cartridge may also be achieved using one hand.

The cartridge may comprise more than one port. For example, the cartridge may comprise at least one fluid inlet port, at least one fluid outlet port and at least one vent. Each fluid outlet port is adapted for fluid flow from the reservoir to the fluid system of the vehicle, for example vehicle engine. Each fluid inlet port is adapted for fluid flow to the reservoir from the fluid system of the vehicle. Each vent port is adapted for flow of gas and/or vapour both (i) from the reservoir to the vehicle, for example to the fluid system of the vehicle engine or (if the engine is an internal combustion engine, for example) to an air inlet manifold of the engine, and (ii) to the reservoir from the vehicle engine, for example from the fluid system of the engine or (if the engine is an internal combustion engine, for example) from an air inlet manifold of the engine.

Each port of the cartridge may comprise a self-sealing port. In general, self-sealing ports have the characteristic that when corresponding ports are being connected, a seal is made between the connecting ports before valve or valves open to allow fluid to flow. On disconnection, the valve or valves close to seal off each of the ports before the seal between the ports is broken. Suitable valves include spring loaded poppet valves and biased non-return valves.

Each self-sealing port of the cartridge may provide a "dry break" in which no fluid flows on connection or disconnection of the ports. Alternatively, each self-sealing port of the system may provide a "damp break" in which there is flow of only a non-essential amount of fluid, for example a few drips of liquid, on disconnection or connection of the port.

In some examples, at least one of the ports comprises a non-return valve. Suitably, the at least one outlet port comprises a non-return valve. If the cartridge comprises more than one outlet port, suitably each outlet port comprises a non-return valve. The non-return valve in the outlet may prevent fluid from draining back to the reservoir for example when the vehicle engine is not operating and may help keep a fluid line to a circulating pump full of fluid so that circulation of fluid is immediate when operation of the engine is started. According to at least some embodiments, the fluid inlet port or ports each comprise a control valve or shut-off valve which may be closed when the vehicle engine is not operating, for example to prevent or reduce fluid draining from the reservoir to the engine.

Suitably, the vent port or vent ports do not contain any non-return valves because fluid, for example gas and/or vapour, may be required to flow both to and from the reservoir through the vent port or vent ports.

Suitably, the corresponding ports on the vehicle fluid system are self-sealing ports. This has an advantage that when the cartridge has been disconnected from the fluid system e.g. the fluid system of a vehicle engine, the risk of ingress of contaminants into the fluid system may be mitigated.

The cartridge may comprise a filter for filtering the fluid. This is suitable when the fluid is an engine lubricating oil composition.

In some embodiments, the reservoir is operable at elevated pressure.

The housing may be manufactured from metal and/or plastics material. Suitable materials include reinforced thermoplastics material which for example, may be suitable for operation at temperatures of up to 150° C. for extended periods of time.

The housing and/or the holder may have an asymmetric configuration selected so that the cartridge can only be coupled to the fluid system when the cartridge is in a selected orientation. The first part of the housing may comprise a key, for example a protrusion or recess configured to engage with a complimentary feature of the engine and/or fluid system. The key may be selected to inhibit the cartridge from being coupled to the fluid system unless the cartridge is in a selected orientation with respect to the fluid system and/or the engine. These and other examples of the disclosure have an advantage that an inexpert user can easily and/or quickly install the cartridge whilst reducing the probability of improper or incomplete fluidic communication between the cartridge reservoir and the fluid system.

The cartridge, for example, the housing may comprise at least one trade mark, logo, product information, advertising information, other distinguishing feature or combination thereof. According to at least some embodiments, the cartridge and/or housing is printed and/or labelled with at least one trade mark, logo, product information, advertising information, other distinguishing feature or combination thereof. The trademark, logo or other distinguishing feature may of the same colour and/or material as the rest of the housing or a different colour and/or material as the rest of the cartridge and/or housing.

The reservoir may be a reservoir for a fluid which is a liquid. Suitable liquids include engine lubricating oil composition, heat exchange fluid for an electric engine, de-icer, water, screen-wash and detergent. The fluid may be a fluid suitable for a sustainable fluid system for example engine lubricating oil compositions and heat exchange fluids. The fluid may be a fluid suitable for a non-sustainable fluid system for example de-icers, water, screen-washes and detergents.

The engine lubricating oil may have heat exchange properties.

According to at least some embodiments, the reservoir is a housing for lubricating oil composition, for example an engine lubricating oil composition. Thus, according to at least some embodiments, the cartridge comprises a reservoir which contains lubricating oil composition, for example lubricating oil composition. In this embodiment, the cartridge may be provided as a self-contained system containing fresh, refreshed or unused lubricating oil composition which may conveniently replace a cartridge on a vehicle for example on a vehicle engine containing used or spent lubricating oil composition. If the housing also comprises a filter, this also is replaced together with the spent or used lubricating oil composition. Thus, a fluid reservoir containing spent or used lubricating oil composition retained in fluidic communication with a vehicle engine fluid system may be disconnected from the vehicle engine fluid circulation system by rotation of the second part with respect to the second part of the housing thereby disengaging the reservoir from fluidic communication with the fluid system and the cartridge from the vehicle. The cartridge may be removed from the vehicle and replaced by a cartridge containing fresh, refreshed or unused lubricating oil composition and if present a fresh, renewed or new filter. According to at least some embodiments, the vehicle fluid system comprises a dry sump crankcase lubricating system which comprises a scavenger pump. In some embodiments, the fluid circulation system comprises a gravity-fed scavenger pump.

In some embodiments, the lubricating oil composition, for example engine lubricating oil composition, comprises of at least one base stock and at least one lubricating oil additive. Suitable base stocks include bio-derived base stocks, mineral oil derived base stocks, synthetic base stocks and semi synthetic base stocks. Suitable lubricating oil additives, for example engine lubricating oil additives, are known in the art. Examples of additives include organic and/or inorganic compounds. Typically, according to at least some embodiments, the engine lubricating oil composition comprises about 60 to 90% by weight in total of base stocks and about 40 to 10% by weight additives. Suitable engine lubricating oil compositions include lubricating oil compositions for internal combustion engines.

The lubricating oil composition may be a mono-viscosity grade or a multi-viscosity grade engine lubricating oil composition. Examples of suitable lubricating oil composition include a single purpose lubricating oil compositions and a multi-purpose lubricating oil compositions.

According to at least some embodiments, the lubricating oil composition is an engine lubricating oil composition, for example an engine lubricating oil composition for an internal combustion engine. According to at least some embodiments, the engine lubricating oil composition is a lubricating oil composition for a spark ignition internal combustion engine. According to at least some embodiments, the engine lubricating oil composition is a lubricating oil composition for a compression internal combustion engine.

In some embodiments, the cartridge comprises a reservoir for heat exchange fluid for an electric engine. Thus, according to at least some embodiments, the reservoir contains heat exchange fluid for an electric engine. In this embodiment, the cartridge may be provided as a self-contained system containing fresh, refreshed or unused heat exchange fluid for an electric engine which may conveniently replace a cartridge on an engine which cartridge comprises a reservoir containing used or spent heat exchange fluid. If the cartridge also comprises a filter, this also is replaced together with the spent or used heat exchange fluid.

Electric engines may require heat exchange fluid to heat the engine and/or cool the engine. This may depend upon the operating cycle of the engine. Electric engines may also require a reservoir of heat exchange fluid. According to at least some embodiments, the fluid reservoir provides a heat storage system in which heat exchange fluid is stored for use to heat the electric engine when required. According to at least some embodiments, the fluid reservoir provides a system for storage of coolant at a temperature below the operating temperature of the engine for use to cool the electric engine when required.

Suitable heat exchange fluids for electric engines include aqueous and non-aqueous fluids. Suitable heat exchange fluids for electric engines include those which comprise organic and/or non-organic performance boosting additives. Suitable heat exchange fluids include be man-made or bio-derived fluids, for example Betaine. According to at least some embodiments, the heat exchange fluids have fire retarding characteristics and/or hydraulic characteristics. Suitable heat exchange fluids include phase change fluids. Suitable heat exchange fluids include molten metals and salts. Suitable heat exchange fluids include nanofluids. Nanofluids comprise nanoparticles suspended in a base fluid, which may be solid, liquid or gas. Suitable heat exchange fluids include gases and liquids. Suitable heat exchange fluids include liquefied gases.

Suitably, the cartridge is operable at temperatures of from ambient temperature up to 200° C., for example from −20° C. to 180° C., or from −10° C. to 150° C.

Suitably, the cartridge is operable at pressures up to 15 barg, for example from −0.5 bar to 10 bar, or from 0 barg to 8 barg.

According to a further aspect of the present disclosure there is provided a holder for coupling a fluid cartridge to a vehicle for example to a vehicle engine, the holder comprising: a connector for providing fluidic communication between a fluid port of the cartridge and a fluid system of a vehicle for example a vehicle engine; and being adapted to receive a cartridge as herein described wherein when the second part of the housing is rotated with respect to the first part of the housing the cartridge is secured with respect to the fluid system and holds the reservoir in fluidic communication, via the port, with the fluid system, and wherein the second part of the housing is configured such that rotating the second part of the housing does not rotate the port.

The connector may comprise a fluid return coupling configured to couple a fluid return line of a fluid system of a vehicle for example of a vehicle the engine to an inlet port of the cartridge; a fluid supply coupling configured to couple a fluid supply line of the fluid system to an outlet port of the cartridge; and a vent coupling configured to couple a pressure control line of the fluid system to a vent port of the cartridge for controlling pressure in the reservoir of the cartridge.

According to further aspects of the disclosure there is provided a fluid reservoir system for a vehicle for example a vehicle engine, comprising a cartridge as herein described and a holder adapted to cooperate with the second part of the housing to secure the port in fluidic communication with a fluid system of the vehicle for example of a vehicle engine. The holder may be a holder as herein described.

An example of a non-sustaining fluid system is a windscreen washer fluid system which draws washer fluid from a cartridge supported in the vehicle. An example of a self-sustaining fluid system is a fluid circulation system, which circulates an engine lubricating oil composition or an engine heat exchange fluid from a fluid reservoir system, through an engine and returns the fluid to the reservoir.

Whilst fluid systems for vehicles, for example vehicle engines, have been described herein the present invention also relates to fluid systems for engines in general whether or not associated with a vehicle. Thus according to a further aspect of the present invention there is provided a cartridge for replenishing an engine fluid, for example a vehicle engine fluid, the cartridge comprising:

a housing comprising a first part and a second part;

a fluid reservoir in the housing;

a port arranged on the first part of the housing to couple the reservoir in fluidic communication with a fluid system of the engine;

wherein the second part of the housing is configured to rotate with respect to the first part of the housing to secure the cartridge with respect to the fluid system to hold the reservoir in fluidic communication, via the port, with the fluid system of the engine, and wherein the second part of the housing is configured such that rotating the second part of the housing does not rotate the port.

According to further aspects of the disclosure there is provided an engine comprising a fluid reservoir system as herein described.

According to further aspects of the disclosure there is provided a cartridge as herein described in communication with the fluid system of a vehicle engine.

According to further aspects of the disclosure there is provided a vehicle comprising an engine comprising a fluid reservoir system as herein described.

The vehicle engine may be an internal combustion engine. Suitable internal combustion engines include spark ignition internal combustion engines and compression ignition internal combustion engines. The vehicle engine may be an electric engine.

Suitable vehicles include motorcycles, earthmoving vehicles, mining vehicles, heavy duty vehicles and passenger cars.

The invention extends to methods and/or apparatus substantially as herein described with reference to the accompanying drawings.

Any feature in one aspect of the invention may be applied to other aspects of the invention, in any appropriate combination. In particular, features of method aspects may be applied to apparatus aspects, and vice versa.

Embodiments of the invention will now be described, by way of example only, with reference to the accompanying drawings in which:

FIG. 1 schematically illustrates an engine and a cartridge for replenishing a vehicle engine fluid of the engine;

Figure 1:
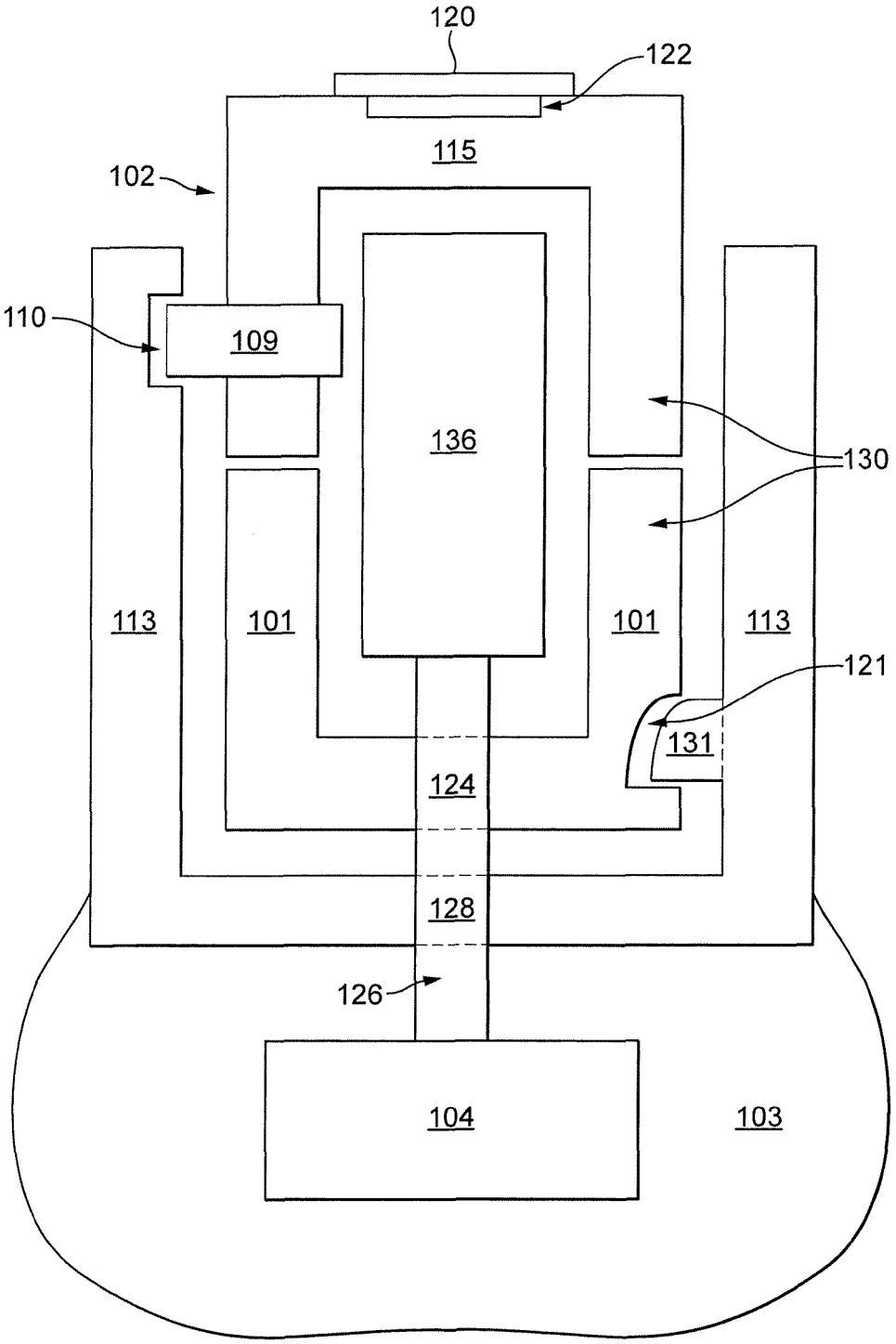

Referring to FIGS. 1 to 6 common features are identified by common reference numerals.

FIG. 1 shows a cartridge 102, a holder 113 and an engine 103.

The holder 113 is arranged to receive the cartridge 102 to secure the cartridge with respect to a fluid system 104 of the engine 103. The engine's fluid system 104 comprises a fluid line 126.

The holder 113 comprises a recess 110 configured to engage with a complementary lug 109 of the cartridge 102. The holder 113 further comprises a key feature 131 and a connector 128 for coupling a cartridge 102 received by the holder 113 to the fluid line 126.

The cartridge 102 comprises a reservoir 136 for holding a fluid, and further comprises a housing 130 which encloses the reservoir 136. A first part 101 of the housing 130 comprises a port 124 and a key 121. The second part 115 of the housing 130 comprises the lug 109, a recess 122 and a bar 120 across the recess 122. The port 124 is operable to provide a fluid coupling between the reservoir 136 and the fluid line 126 via the connector 128.

The housing 130 of the cartridge 102 is receivable within the holder 113. The second part 115 of the housing 130 is arranged for rotation with respect to the first part 101 of the housing 130 to couple the cartridge to the holder 113 via engagement of the lug 109 of the second part 115 of the housing 130 with the complementary recess 110 of the holder 113.

The key 121 of the first part 101 of the housing 130 is configured to be coupleable to the key feature 131 of the holder 113 only when the cartridge 102 is in a selected orientation with respect to the fluid system 104.

The port 124 of the first part 101 of the housing 130 is arranged to be coupleable with the connector 128 of the holder 113 when, in use, the lug 109 of the second part of the housing 130 is engaged with the recess 110 of the holder 113, and the respective key features 121, 131 of the cartridge and housing are engaged. This helps to ensure that the cartridge (and hence the cartridge port) is secured and correctly oriented with respect to the fluid system when the cartridge is replaced.

Thus when, in use, the lug 109 of the second part 115 of the housing 130 is engaged with the recess 110 of the holder 113, the port 124 is secured to the connector 128 to provide fluidic communication between the reservoir 136 and the fluid system 104 via the fluid line 126.

In operation, to install the cartridge 102 (e.g. to replace or replenish the engine fluid) the cartridge is inserted into the holder 113 and oriented so that the key 121 of the cartridge engages with the key feature 131 of the holder to align the port 124 of the cartridge with the connector 128 of the fluid system.

Once the housing 130 is aligned in the holder 113, the second part 115 of the housing 130 is rotated relative to the first part 101 of the housing 130 to rotate the lug 109 into engagement with the recess 110 of the holder 113 to secure the housing 102 with respect to the fluid system 103. In this way, securing the housing 130 to the holder 113 restrains the port 124 in fluidic communication with the connector 128 to provide fluidic communication between the reservoir 136 and the fluid system 104.

Because the second part 115 of the housing 130 is arranged to rotate relative to the first part 101 of the housing 101, the port 124 is not forced to rotate by coupling the cartridge 102 to the fluid system 104. This allows the cartridge 102 to be simply and securely coupled to the fluid system 104 via a secure twist lock, while mitigating or reducing the likelihood of twisting the fluid line 126 whilst coupling or decoupling the cartridge 102.

To remove the cartridge 102, the second part 115 of the housing 130 is rotated to move the lug 109 out of engagement with the recess 110 to disengage the housing 130 from the holder 113. Once disengaged from the holder 113 and decoupled from the fluid system 104, the cartridge 102 may be removed from the holder 113 using the handle 120.

As will be appreciated by the skilled addressee in the context of the present disclosure, the cartridge 102 may be a removable refill for an engine lubricating oil composition, or any other engine fluid such as a heat exchange fluid, de-icer, water, screen-wash, or detergent.

The engine lubricating oil may have heat exchange properties.

The housing 130 may be a substantially cylindrical shell arranged to contain the reservoir 136. However, the housing may be any shape. The housing is described as carrying a key 121, however the key 121 may be provided by the shape of the housing—for example the housing and/or the holder may have an asymmetric configuration selected so that the cartridge can only be coupled to the fluid system when the cartridge 102 is in a selected orientation.

The port 124 may comprise a self-sealing coupling. This has an advantage that when the fluid cartridge has been disconnected from the engine, the risk of fluid exiting the reservoir is reduced or prevented. The self-sealing coupling has the characteristic that when the reservoir 136 is being connected to the fluid line 126, a seal is made between the port 124 and the connector 128 before valves of the port 124 or the connector 128 open to allow engine oil to flow there between. On disconnection, the valve or valves close to seal off each of the port 124 and the connector 128 before the seal between the port 124 and the connector 128 is broken.

The connector 128 may comprise a self-sealing coupling. This has an advantage that when the fluid cartridge has been disconnected from the engine, the risk of ingress of contaminants into the engine and in particular the engine fluid system, may be mitigated. The self-sealing coupling has the characteristic that when the reservoir 136 is being connected to the fluid line 126, a seal is made between the port 124 and the connector 128 before valves of the port 124 or the connector 128 open to allow engine oil to flow there between. On disconnection, the valve or valves close to seal off each of the port 124 and the connector 128 before the seal between the port 124 and the connector 128 is broken.

The connector 128 and/or the port 124 and/or the fluid line 126 may comprise a non-return valve (not shown).

The second part 115 of the housing 130 is shown in FIG. 1 as a cuff carried by the first part 101 of the housing 130 however, the second part 115 of the housing may be arranged partially or completely within the first part 101 of the housing 130.

The cartridge is described as comprising a handle provided by a recess 122 and a bar 120, and this has the advantage of enabling the cartridge to be conveniently manipulated with one hand, however, other types of handle may be used. The handle, whether provided by a bar or otherwise can be adapted to permit carrying of the cartridge.

The first part 101 of the housing has been described as carrying a lug 109 to engage with a corresponding recess 110. However, the housing 130 may comprise recesses for engaging with lugs of the holder. Any combination of complementary features may be used to engage the cartridge 102 with the holder 113.

The connector 128 may comprise a return coupling configured to couple a fluid return line of the fluid line 126 to an inlet port of the port 124 of the first part 101 of the housing, a supply coupling configured to couple a fluid supply line of the fluid line 126 to an outlet port of the port 124 of the first part 101 of the housing, a vent coupling of the fluid line configured to couple to a vent line of the fluid line 126 to a vent port of the port 124 of the first part of the housing 130 for controlling pressure in the reservoir 136. In such examples, the fluid line 126 comprises a fluid supply line for supplying fluid from the reservoir 136 to the engine components, a fluid return line for returning circulated fluid to the reservoir 136 and a vent line for controlling pressure in the reservoir 136.

Figure 2:
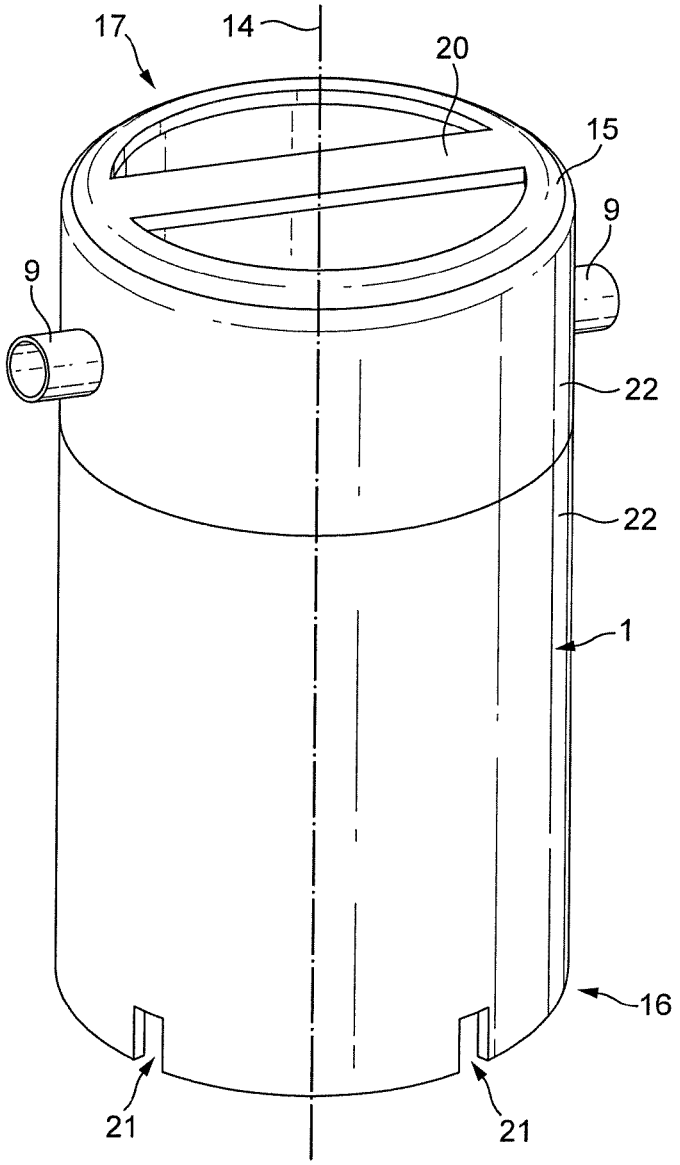
FIG. 2 represents in schematic elevation view a cartridge suitable for replenishing a vehicle engine fluid of an engine.
Figure 3:
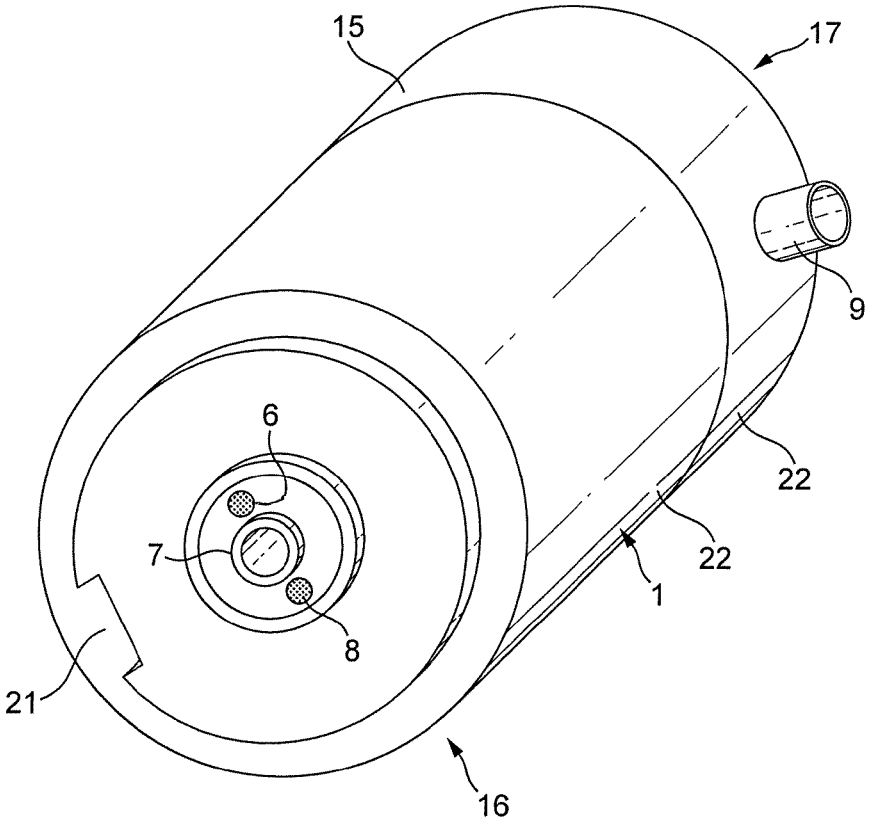
FIG. 3 represents another schematic elevation view of the cartridge of FIG. 2.

FIGS. 2 and 3 show in schematic form one example of a cartridge 1 such as that described with reference to FIG. 1 which provides a fluid reservoir system 2 for a vehicle engine indicated by reference numeral 3 in FIGS. 4 and 5. The engine comprises a fluid system indicated by reference numeral 4 in FIGS. 4 and 5.

A fluid reservoir system 2 comprises a cartridge 1 which comprises a housing 22 which comprises a first part 16 and a second part 15. The second part 15 of the housing is configured to rotate with respect to the first part 16 of the housing about a common axis 14 to secure the cartridge 1 with respect to the fluid system 4 of a vehicle engine 3, to hold the reservoir (not shown) in fluidic communication via the ports 6, 7, 8, with the fluid system 4 of the engine 3 wherein the second part of the housing 15 is configured such that rotating the second part 15 of the housing does not rotate the ports 6,7,8.

The cartridge 1 comprises a fluid inlet port 6, a fluid outlet port 7 and a vent port 8, said ports being self-sealing ports and being adapted in use to connect to corresponding ports not shown on the fluid system 4 of an engine 3.

The fluid (not shown) in the reservoir 1 may be an engine lubricating oil composition or an engine heat exchange fluid. Suitably, the fluid is an engine lubricating oil composition. The cartridge may comprise a filter not shown. The cartridge 1 is elongate and comprises a first end 16 and a second end 17.

The fluid reservoir system 2 comprises a holder which is a sleeve 13 (shown in FIGS. 4 and 5 in part cut-away view) adapted to receive the cartridge 1. Which sleeve has a longitudinal axis 11 which in use, when the sleeve 13 has received the cartridge 1, is common with the axis 14 and which sleeve comprises two recesses 10 which are slots in the sleeve 13.

Figure 4:
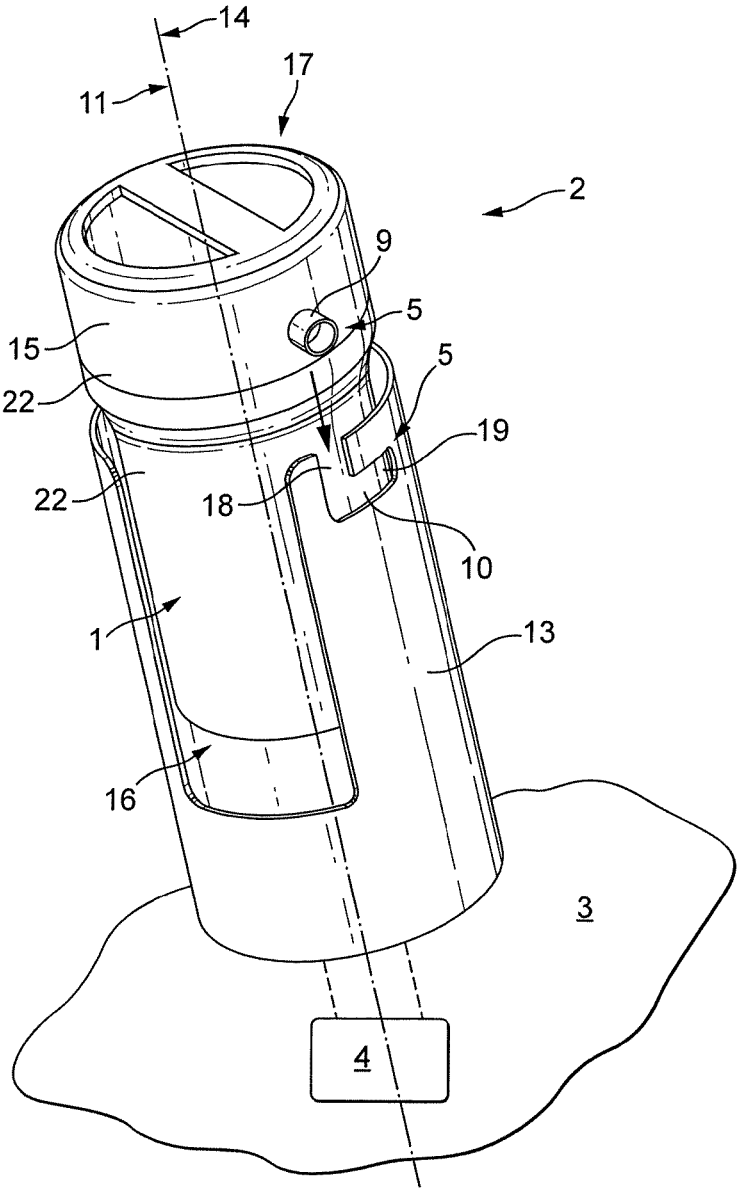
FIGS. 4 and 5 represent in schematic form the cartridge of FIGS. 2 and 3 in two stages of assembly with a sleeve associated with an engine.
Figure 5:
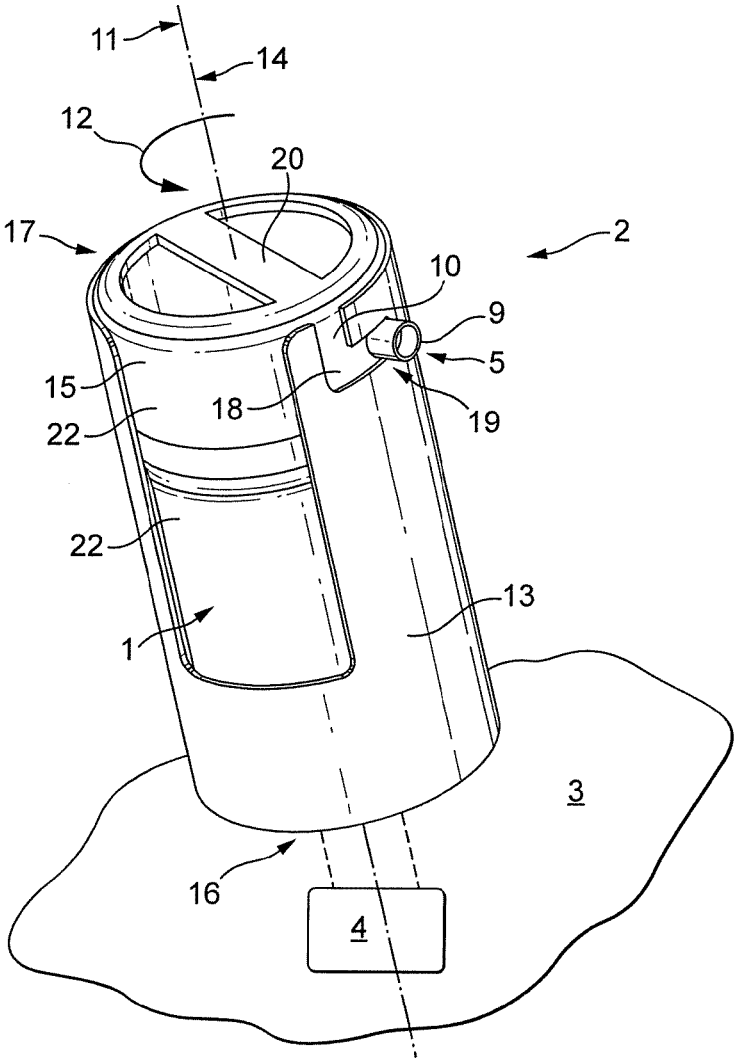

The second part 15 of the cartridge 1 comprises two lugs 9 engageable with two corresponding recesses which are slots 10 in a holder which is the sleeve 13 (shown in FIGS. 4 and 5). Each lug 9 and corresponding recess 10 being co-operable with each other by rotation in a first direction relative to each other about a rotational axis which is common to all of said lugs and corresponding recesses and corresponds to the axis 14 of the housing 22 and to axis 11 of the sleeve 13, whereby in use, said lugs 9 and recesses 10 are engageable to secure the cartridge 1 with respect to the fluid system 4 to hold the reservoir (not shown) in fluidic communication, via ports 6,7,8 with the fluid system 4 of the engine 3. Rotation of the second part 15 in a second direction opposite to the first direction disengages the lugs and recesses, thereby disengaging said cartridge 1 and reservoir (not shown) from said engine fluid system 4.

The reservoir system 2 comprises a housing 22 having a second part provided by a turret 15, at least a portion of which is rotatable about the rotational axis 14 to engage or disengage the lugs 9 and their corresponding recesses 10. The turret 15 further comprises a handle 20 which is adapted to permit carrying of the cartridge 1 and rotation of the turret 15 about the longitudinal axis 14 of the cartridge 1.

The self-sealing ports 6, 7, 8 of the cartridge 1 are located at one end 16 of the elongate cartridge and the turret 15 is located at the opposite end 17 of the elongate cartridge 1. The cartridge comprises several keys 21 engageable with corresponding features not shown on the sleeve so as to ensure that each port on the cartridge is engaged with the appropriate port of the engine fluid system.

The turret 15 comprises two lugs 9 which extend radially from said turret and the sleeve 13 comprises two corresponding recesses 10 which are slots.

Each slot 10 comprises a first portion 18 which is generally parallel to the rotational axis 14 and a second portion 19 which is generally at right angles to said first portion 18 whereby in use with each lug 9 engaged with the first portion 18 of its corresponding recess, said first portion 18 permits axial movement of the cartridge 1 along said axis 14 which is the longitudinal axis of said cartridge, and with each lug 9 engaged with the second portion 19 of its corresponding recess, said second portion 19 permits relative rotation of said lugs 9 and their corresponding recesses 10 to secure the cartridge 1 with respect to the fluid system 4 to hold the reservoir (not shown) in fluidic communication, via the ports 6, 7, 8 with the fluid system 4 of the engine 3, wherein rotating the second part 15 does not rotate the port 2 6, 7 8.

FIGS. 4 and 5 show in schematic form engaging the cartridge 1 with the sleeve 13. Using the handle 20 an operator may lift the cartridge 1 and position it in the sleeve 13. As shown in FIG. 4, the sleeve 13 receives the cartridge 1 and each lug 9 engages a first portion 18 of a recess which is a slot 10 in the sleeve 13. The first portion permits axial movement of the cartridge along the common axes 11, 14 in the direction A shown in FIG. 4 and using the handle 20 the cartridge may be moved in the direction A until the ports 6, 7, 8 engage with corresponding ports on the engine fluid system.

When the ports 6, 7, 8 engage with corresponding ports on the engine fluid system, each lug engages a second portion 19 of the corresponding recess which is a slot 10 which is generally at right angles to said first portion 18. As shown in FIG. 5, the second portion 19 permits relative rotation of each lug 9 with respect to its corresponding recesses which is a slot 10 in the direction B which is about the common axis of rotation 11. Thus, rotation of the turret 15 by the operator using the handle 20 causes each lug to rotate about the common axis of rotation relative to its corresponding recess/slot. Since the rotation of the turret 15 is independent of the ports 6 7 8, the lugs may be rotated relative to the recesses/slots without rotating the ports 6 7 8.

The recesses/slots may comprise a third detent portion to retain the lugs in engagement with the slots.

The cartridge may be removed from the engine fluid system by reversing the steps described hereinbefore. After the disconnected cartridge has been removed from the engine and vehicle, another cartridge which may contain fresh, refreshed or unused fluid may be reconnected to the engine fluid system.

The fluid reservoir system provides a convenient way of supplying a fluid for a vehicle engine system from a reservoir which may be engaged and disengaged in simple operations, for example using a handle on a rotatable turret on the cartridge which is engageable with a holder, for example a sleeve on the engine.

Figure 6:
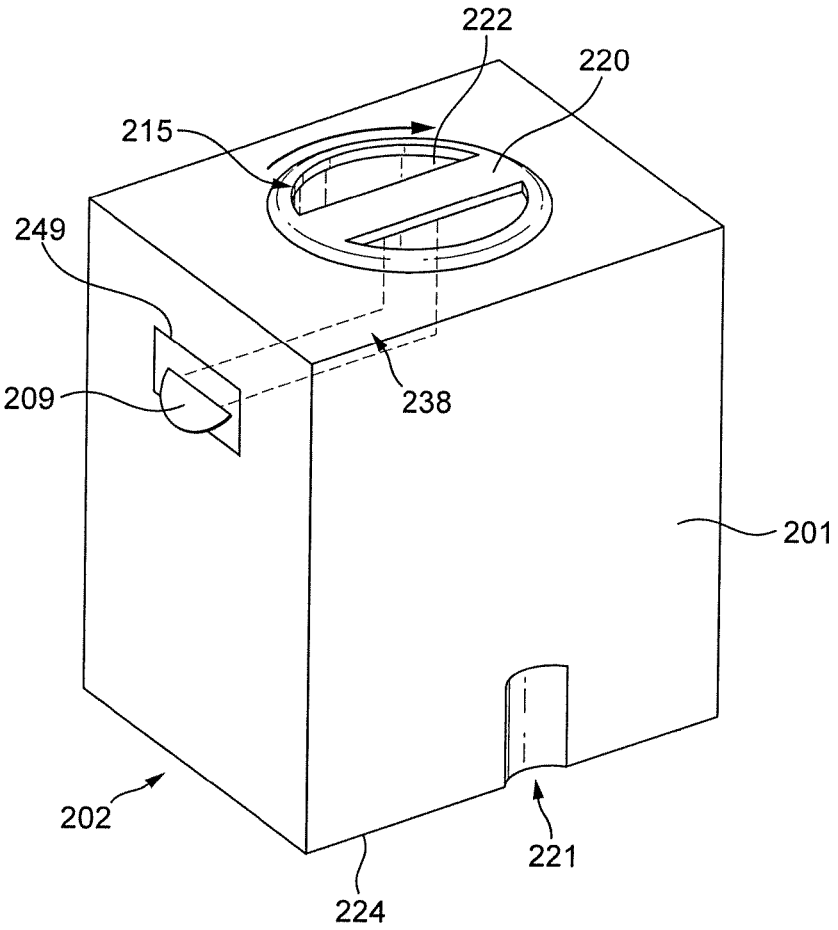
FIG. 6 represents in schematic form another example of a cartridge.

FIG. 6 shows another example of a cartridge 202 having a housing comprising a first part 201 and a second part. In FIG. 6 the second part of the housing is provided by a rotatable cap 215 seated in a recess of the first part 201 of the housing.

The cap 215 comprises a handle provided by a bar 220 arranged across a recess 222. The cap 215 is coupled to a deployable lug 209 via an actuator 238 which is configured to deploy the deployable lug 209 from the cartridge 202 in response to the cap 215 being rotated through a selected angle with respect to the first part 201 of the housing. The actuator 238 is also operable to retract the deployed lug 209 into the cartridge 202 in response to a rotation of the cap 215.

The cartridge 202 also comprises a key 221 on the first part 201 of the housing and configured to be coupleable to a key feature (such as key of the holder shown in FIG. 1) only when the cartridge 202 is in a selected orientation with respect to the fluid system.

In FIG. 6, the first part 201 of the housing contains the actuator 238 and the deployable lug 209. A slot 249 of the first part 201 of the housing is arranged to allow the deployable lug 209 to be deployed by extending from the housing through the slot 249.

The actuator 238 is arranged such that rotation of the cap 215, as indicated by the arrow in FIG. 6, causes the deployable lug to be extended through the slot 249, and a reverse rotation back causes the deployable lug 209 to be retracted through the slot 249 into the first part 201.

The first part 201 of the housing of the cartridge 202 shown in FIG. 6 comprises a substantially rectangular housing. It will be appreciated by the skilled reader in the context of the present disclosure that a complementary holder can be provided in a similar manner to that described in relation to FIG. 1 and/or FIG. 4 and FIG. 5, although the recess of the holder is adapted to cooperate with the deployable lug 209 of FIG. 6 rather than the bayonet type lug 109 of FIG. 1 and the lugs 9 of FIGS. 2 to 5.

The port of the first part 201 of the housing is arranged to couple the cartridge 202 in fluidic communication with the fluid system of an engine, as in FIG. 1, when the deployable lug 209 is engaged with a corresponding recess 210 of a holder. The cartridge 202 is operable to be disengaged from the holder by counter rotation of the cap 215 to retract the lug.

In operation, to install the cartridge 202 of FIG. 6 (e.g. to replace or replenish the engine fluid) the cartridge is inserted into a holder (such as the holder of FIG. 1) and oriented so that the key 221 of the cartridge engages with a key feature of the holder to align the port of the cartridge with the connector of the fluid system.

Once the housing is aligned in the holder, the cap 215 is rotated relative to cause the actuator 238 to deploy the lug 209 into engagement with a recess of a holder (not shown in FIG. 6) to secure the cartridge 202 with respect to a fluid system. In this way, the port of the cartridge 202 is secured in fluidic coupling with a connector of the fluid system to provide secure fluidic communication between the reservoir of the housing and the fluid system.

Because the cap 215 is arranged to rotate relative to the first part 201 of the housing, the port is not forced to rotate by coupling the cartridge 202 to the fluid system. This allows the cartridge 202 to be simply and securely coupled to the engine fluid system via a secure twist lock, while mitigating or reducing the likelihood of twisting the fluid lines of the fluid system whilst coupling or decoupling the cartridge 202 from the engine fluid system.

To remove the cartridge 202, the cap 215 is rotated to cause the actuator 238 to retract the lug 209 to disengage the cartridge 202 from the holder. Once disengaged from the holder, and decoupled from the fluid system, the cartridge 202 may be removed from the holder using the bar 220.

The actuator 238 may be provided by a mechanical means, such as an arm coupled between the cap 215 and the lug 209. Other mechanical actuators may also be used such as arrangements of cogs, and/or worm drives. In some examples the actuator 238 may be an electromechanical actuator. The actuator may be configured to deploy the lug in response to rotation of the cap 215 in a first direction, and to retract the lug 209 in response to rotation in a second direction. The actuator 238 may be configured so that rotation through a first selected angle causes the lug 209 to be deployed, and further rotation through a second selected angle causes the lug to be retracted. The selected angle may be less than 360°, in some examples less than 180°.

The ports of the cartridges described with reference to FIGS. 1 to 6 may comprise a fluid inlet port, a fluid outlet port, and a vent port to couple the first part of the housing, or housing 1, to a fluid return line, a fluid supply line and a fluid vent line of the fluid system respectively. The vent line may be arranged to provide control of the pressure in the reservoir of the cartridge.

In the example of FIGS. 1 and 2, the lock feature of the housing comprises a protrusion 109 and the corresponding lock feature 110 of the holder 113 comprises a recess 110 configured to engage with the protrusion 109. It will be appreciated that an engageable protrusion and recess can be provided by a bayonet coupling. FIGS. 4 and 5 show one bayonet coupling comprising a lug 9 of the housing 2 and a recess 10 of a sleeve arranged to provide a locking system 5 between the housing and the sleeve 13.

In the example of FIG. 1 and FIG. 6, the second part of the housing 115, 215 is arranged to be rotated with respect to the first part 101, 201 of the housing with a handle provided by a recess 122, 222 and a bar 120, 220 across the recess 122, 222. It will be appreciated that any suitable handle arrangement could be provided for rotating the second part and, preferably, for removing the cartridge 102, 202 from the holder 13. FIGS. 4 to 6 show examples of a handle arranged on an upper surface of a fluid reservoir system 2 for rotating the turret 15 with respect to the housing 1 to secure the reservoir system 2 with respect to a fluid circulation system 4 via engagement of the bayonet locking system 5.

While the embodiment of FIG. 1 describes a fluid system 4 of an engine 3, it will be appreciated that the cartridge 2 of FIG. 1 could be coupled to any vehicle fluid system 4 via an appropriate fluid line 26 of the fluid system 4. Examples of engine, fluid systems 4 include a non-sustainable fluid system 4 with draws fluid from the cartridge 2 to supply a vehicle component and, in so doing, depletes the fluid in the cartridge 2, and a self-sustaining fluid circulation system which draws fluid from the cartridge 2 to supply a vehicle component and, having done so, returns the fluid to the cartridge 2. An example of a non-sustaining fluid system is a windscreen washer fluid system which draws washer fluid from a cartridge supported in the engine 3. An example of a self-sustaining fluid system is a fluid circulation system 4, which circulates an engine lubricating oil composition or an engine heat exchange fluid from a fluid reservoir system 2, and an example of such a system is described in relation to FIGS. 4 and 5.

The fluid system may be part of an engine. The engine may be part of a vehicle.

It will be understood that the present invention has been described above purely by way of example, and modification of detail can be made within the scope of the invention.

While aspects of the invention have been described in relation to vehicle engines and examples of the invention described the use of engine lubricating oil compositions, it is envisaged that features of the invention could find other applications.

For example, a cartridge according to an aspect of the invention could be used in relation to a wide range of apparatus or equipment. For example, the cartridge could find application in relation to various static and movable machines, for example industrial machines such as a lathe, or manufacture and assembly equipment, to an engine, or to a vehicle.

Examples of a cartridge of an aspect of the invention could thus be used to supply lubricant composition to a region of the apparatus or equipment, for example to a region including one or more moving parts, for example a gearbox. In an example of an aspect of the invention there is provided a cartridge for a wind turbine, for example to provide lubricating composition to one or more parts of the wind turbine apparatus.

The cartridge may supply a lubricant composition to the apparatus, or may supply fluid other than lubricant to the apparatus. For example, the fluid may comprise a fuel composition, for example gasoline or diesel The reservoir of an aspect of the invention may be for supply the fluid for example to the fuel supply system of the apparatus. For example, the reservoir may supply fuel to a vehicle, or tool, for example to a car, motorcycle or lawn mower.

In another example, the cartridge is used to supply a fluid, for example lubricant and/or fuel, to a hand tool, for example a hedge trimmer or leaf blower.

The fluid may comprise for example an aqueous or other solvent-based composition, for example a cleaning composition. The fluid may for example comprise windscreen wash fluid. A cartridge of an example of an aspect of the invention may be for supplying fluid to the windscreen washer fluid delivery system for example of a vehicle.

Thus in some examples of aspects of the invention the fluid system may comprise a fluid circulation system; in others, the fluid system comprises a one-way fluid delivery system.

Each feature disclosed in the description, and (where appropriate) the claims and drawings may be provided independently or in any appropriate combination.

According to another aspect of the invention, there is provided a cartridge for replenishing a fluid in an apparatus, the cartridge comprising:

a housing comprising a first part and a second part;

a fluid reservoir in the housing;

a port arranged on the first part of the housing to couple the reservoir in fluidic communication with a fluid system of the apparatus;

wherein the second part of the housing is configured to rotate with respect to the first part of the housing to secure the cartridge with respect to the fluid system to hold the reservoir in fluidic communication, via the port, with the fluid system of the apparatus, and wherein the second part of the housing is configured such that rotating the second part of the housing does not rotate the port.

Also provided by an aspect of the invention is a holder for coupling a fluid cartridge to an apparatus, the holder comprising:

a connector for providing fluidic communication between a fluid port of the cartridge and a fluid system of the apparatus;

and being adapted to receive a cartridge as described herein, wherein when the second part of the housing is rotated with respect to the first part of the housing, the cartridge is secured with respect to the fluid system and holds the reservoir in fluidic communication, via the port, with the fluid system of the apparatus, and wherein the second part of the housing is configured such that rotating the second part of the housing does not rotate the port.

The invention claimed is:

1. A cartridge for replenishing a vehicle fluid, the cartridge comprising:

a housing comprising a first part and a second part;

a fluid reservoir configured to hold the vehicle fluid, wherein the fluid reservoir is in the housing; and a port arranged on the first part of the housing to couple the fluid reservoir in fluidic communication with a fluid system of a vehicle;

wherein the second part of the housing is configured to rotate with respect to the first part of the housing to secure the cartridge with respect to the fluid system to hold the fluid reservoir in fluidic communication, via the port, with the fluid system of the vehicle, and wherein the second part of the housing is configured such that rotating the second part of the housing does not rotate the port.

2. The cartridge of claim 1, wherein the first part of the housing and the second part of the housing cooperate to enclose the fluid reservoir.

3. The cartridge of claim 1 wherein the second part of the housing comprises one of a turret, a cuff, and a cap carried by the first part of the housing.

4. The cartridge of claim 1, wherein the second part of the housing comprises a recess and a bar across the recess to provide a handle for rotating the second part of the housing and removing the cartridge from the fluid system.

5. The cartridge of claim 1, wherein the cartridge comprises a deployable lug arranged to be deployed from the cartridge to secure the cartridge with respect to the fluid system in response to rotation of the second part of the housing.

6. The cartridge of claim 1, wherein the first part of the housing has an asymmetric configuration configured to control orientation of the cartridge with respect to the fluid system when, in use, the port is in fluidic communication with the fluid circulation system.

7. The cartridge of claim 6, wherein the asymmetric configuration comprises a key configured to engage with a feature of a holder for the cartridge.

8. The cartridge of claim 1, wherein the second part of the housing is configured to provide a bayonet fitting which is operable to secure the cartridge with respect to the fluid system by rotating the second part of the housing with respect to the first part of the housing.

9. The cartridge of claim 1, wherein the housing is arranged to be received by a holder on an engine, and the second part of the housing is configured to rotate to engage with the holder to secure the cartridge with respect to the fluid system and to hold the fluid reservoir in fluidic communication with the fluid system.

10. The cartridge of claim 1, wherein the second part of the housing is configured to rotate through less than 360 degrees with respect to the first part of the housing to secure the cartridge with respect to the fluid system to hold the fluid reservoir in fluidic communication, via the port, with the fluid system by rotating the second part of the housing.

11. The cartridge of claim 1, wherein the port comprises a releasable self-sealing port.

12. The cartridge of claim 1 in which the fluid reservoir contains vehicle fluid and the vehicle fluid comprises engine lubricating oil composition, heat exchange fluid for an electric engine, de-icer, water, screen-wash or detergent.

13. A holder for coupling a fluid cartridge to a vehicle, the holder comprising:

a connector for providing fluidic communication between a fluid port of the cartridge and a fluid system of the vehicle;

and being adapted to receive a cartridge in accordance with claim 1, wherein when the second part of the housing is rotated with respect to the first part of the housing, the cartridge is secured with respect to the fluid system and holds the fluid reservoir in fluidic communication, via the port, with the fluid system of the vehicle, and wherein the second part of the housing is configured such that rotating the second part of the housing does not rotate the port.

14. The holder of claim 13 wherein the connector comprises:

a fluid return coupling configured to couple a fluid return line of a fluid system of a vehicle to an inlet port of the cartridge;

a fluid supply coupling configured to couple a fluid supply line of the fluid system to an outlet port of the cartridge; and a vent coupling configured to couple a pressure control line of the fluid system to a vent port of the cartridge for controlling pressure in the fluid reservoir of the cartridge.

15. A fluid reservoir system comprising a cartridge for replenishing a fluid in an apparatus, the cartridge comprising:

a housing comprising a first part and a second part;

a fluid reservoir configured to hold the fluid, wherein the fluid reservoir is in the housing; and a port arranged on the first part of the housing to couple the fluid reservoir in fluid communication with a fluid system of the apparatus;

wherein the second part of the housing is configured to rotate with respect to the first part of the housing to secure the cartridge with respect to the fluid system to hold the reservoir in fluidic communication, via the port, with the fluid system of the apparatus, and wherein the second part of the housing is configured such that rotating the second part of the housing does not rotate the port.

16. The fluid reservoir system of claim 15 further comprising a holder for coupling the cartridge to the apparatus, the holder comprising:

a connector for providing fluidic communication between a fluid port of the cartridge and the fluid system of the apparatus;

and being adapted to receive the cartridge, wherein when the second part of the housing is rotated with respect to the first part of the housing, the cartridge is secured with respect to the fluid system and holds the fluid reservoir in fluidic communication, via the port, with the fluid system of the apparatus, and wherein the second part of the housing is configured such that rotating the second part of the housing does not rotate the port.

17. The fluid reservoir system of claim 15 further comprising a holder adapted to cooperate with the second part of the housing to secure the port in fluidic communication with the fluid system of the apparatus.

18. The cartridge of claim 1, wherein the cartridge comprises a first end and a second end opposite the first end, wherein the port is arranged on the first part of the housing at the first end, and wherein at least a portion of the second part of the housing is arranged at the second end.

19. The cartridge of claim 1, wherein the port comprises a valve.

20. The cartridge of claim 4, wherein the first part of the housing comprises a first face, wherein the second part of the housing comprises a second face opposite the first face, wherein the port is arranged on the first part of the housing at the first face, and wherein the handle is arranged at the second face.

21. The cartridge of claim 5 further comprising an actuator between the second part of the housing and the deployable lug, wherein the actuator deploys the deployable lug in response to rotation of the second part of the housing.

* * * * *